US012565362B2

(12) United States Patent
Rupp

(10) Patent No.: US 12,565,362 B2
(45) Date of Patent: Mar. 3, 2026

(54) FLEXIBLE POUR SPOUT

(71) Applicant: Snowie LLC, Salt Lake City, UT (US)

(72) Inventor: Carl A. Rupp, Salt Lake City, UT (US)

(73) Assignee: Snowie LLC, Salt Lake City, UT (US)

( * ) Notice: Subject to any disclaimer, the term of this patent is extended or adjusted under 35 U.S.C. 154(b) by 210 days.

(21) Appl. No.: 18/429,296

(22) Filed: Jan. 31, 2024

(65) Prior Publication Data

US 2024/0253872 A1 Aug. 1, 2024

Related U.S. Application Data

(60) Provisional application No. 63/482,562, filed on Jan. 31, 2023.

(51) Int. Cl.

| | |
|---|---|
| ***B65D 47/06*** | (2006.01) |
| ***B65D 25/48*** | (2006.01) |
| ***B65D 47/12*** | (2006.01) |
| ***B65D 51/16*** | (2006.01) |

(52) U.S. Cl.

CPC ..... *B65D 47/12* (2013.01); *B65D 25/48* (2013.01); *B65D 47/06* (2013.01); *B65D 51/165* (2013.01)

(58) Field of Classification Search

CPC ..... B65D 47/12; B65D 51/165; B65D 47/06; B65D 25/48

See application file for complete search history.

(56) References Cited

U.S. PATENT DOCUMENTS

| | | | | |
|---|---|---|---|---|
| 1,908,584 | A * | 5/1933 | Heinrich | B65D 47/2037 222/491 |
| 2,957,614 | A * | 10/1960 | Krajcovic | B65D 47/04 229/125.17 |
| 3,858,773 | A * | 1/1975 | Del Bon | B65D 47/2037 222/529 |
| 4,080,989 | A * | 3/1978 | Chapelsky | B65D 47/06 137/637.1 |
| 4,216,880 | A * | 8/1980 | Drelichowski | B65D 25/465 222/541.9 |
| 4,415,097 | A * | 11/1983 | Meins | B65D 25/44 222/530 |
| 6,050,433 | A * | 4/2000 | Russell | B65D 47/2043 220/252 |
| 6,230,944 | B1 * | 5/2001 | Castellano | B65D 47/243 222/481.5 |

(Continued)

*Primary Examiner* — Frederick C Nicolas

(74) *Attorney, Agent, or Firm* — TechLaw Ventures, PLLC; Terrence J. Edwards

(57) ABSTRACT

A flexible pour spout for controlling a flow of fluid. A pour spout includes a proximal portion configured to be inserted into an opening of a container and a distal portion configured to extend outside the container when the proximal portion is inserted into the opening of the container. The proximal portion includes a first sidewall defining a first internal cavity and a collar attached to an external side of the first sidewall. The distal portion includes a second sidewall defining a second internal cavity and a terminal opening located at a distal end of the second sidewall. The second sidewall comprises a bend such that at least a portion of the second sidewall collapses along the bend to reduce a size of the terminal opening in response to applying a pressure to the second sidewall.

20 Claims, 16 Drawing Sheets

(56) References Cited

U.S. PATENT DOCUMENTS

| | | | | |
|---|---|---|---|---|
| 6,742,678 | B1 * | 6/2004 | Krystopik, Jr. | B65D 47/122 222/481.5 |
| 8,944,297 | B2 * | 2/2015 | Agassi | B65D 47/12 222/481.5 |
| 2006/0196895 | A1 * | 9/2006 | Trejo | A61C 15/02 222/528 |
| 2012/0091171 | A1 * | 4/2012 | Lovelace, III | B65D 47/127 222/481.5 |
| 2016/0176589 | A1 * | 6/2016 | Averill | B01F 25/43161 222/190 |
| 2019/0292502 | A1 * | 9/2019 | Leverich | C12H 1/063 |
| 2019/0389633 | A1 * | 12/2019 | Beijl | B65D 47/066 |
| 2022/0380094 | A1 * | 12/2022 | Walker | B65D 47/32 |

* cited by examiner

FLEXIBLE POUR SPOUT

CROSS-REFERENCE TO RELATED APPLICATIONS

This application claims the benefit of U.S. Provisional Patent Application No. 63/482,562, filed Jan. 31, 2023, entitled "FLEXIBLE POUR SPOUT," which is incorporated herein by reference in its entirety, including but not limited to those portions that specifically appear hereinafter, the incorporation by reference being made with the following exception: In the event that any portion of the above-referenced provisional application is inconsistent with this application, this application supersedes the above-referenced provisional application.

TECHNICAL FIELD

The present disclosure relates generally to pour spouts, and more specifically to a device and system for dispensing and serving liquids.

BACKGROUND

Consumers and food-service industries commonly utilize pour spouts (also known as pourers or spout stoppers) when pouring liquids from a bottle, jug, or other container. Pour spouts facilitate pouring and enable greater control over the flow of liquid. Traditional pour spouts are constructed from a rigid plastic or metal and provide an opening on either end for controlling the flow of liquid. These traditional pour spouts may additionally serve as a cap on the container to prevent spillage. However, these traditional pour spouts are commonly uniform in shape and size and offer only a single volumetric flow rate per pour spout.

In many cases, there is a benefit to controlling and adjusting the volumetric flow rate from the pour spout while utilizing the pour spout. This might be particularly beneficial when controlling the flow of a beverage or a liquid food topping, such as a flavored topping for shaved ice. Traditional pour spouts fail to provide this benefit and instead provide only a single volumetric flow rate.

In view of the foregoing, disclosed herein are systems, methods, and devices for providing controllable and variable volumetric flow rates when dispensing a liquid.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

Figure 1:
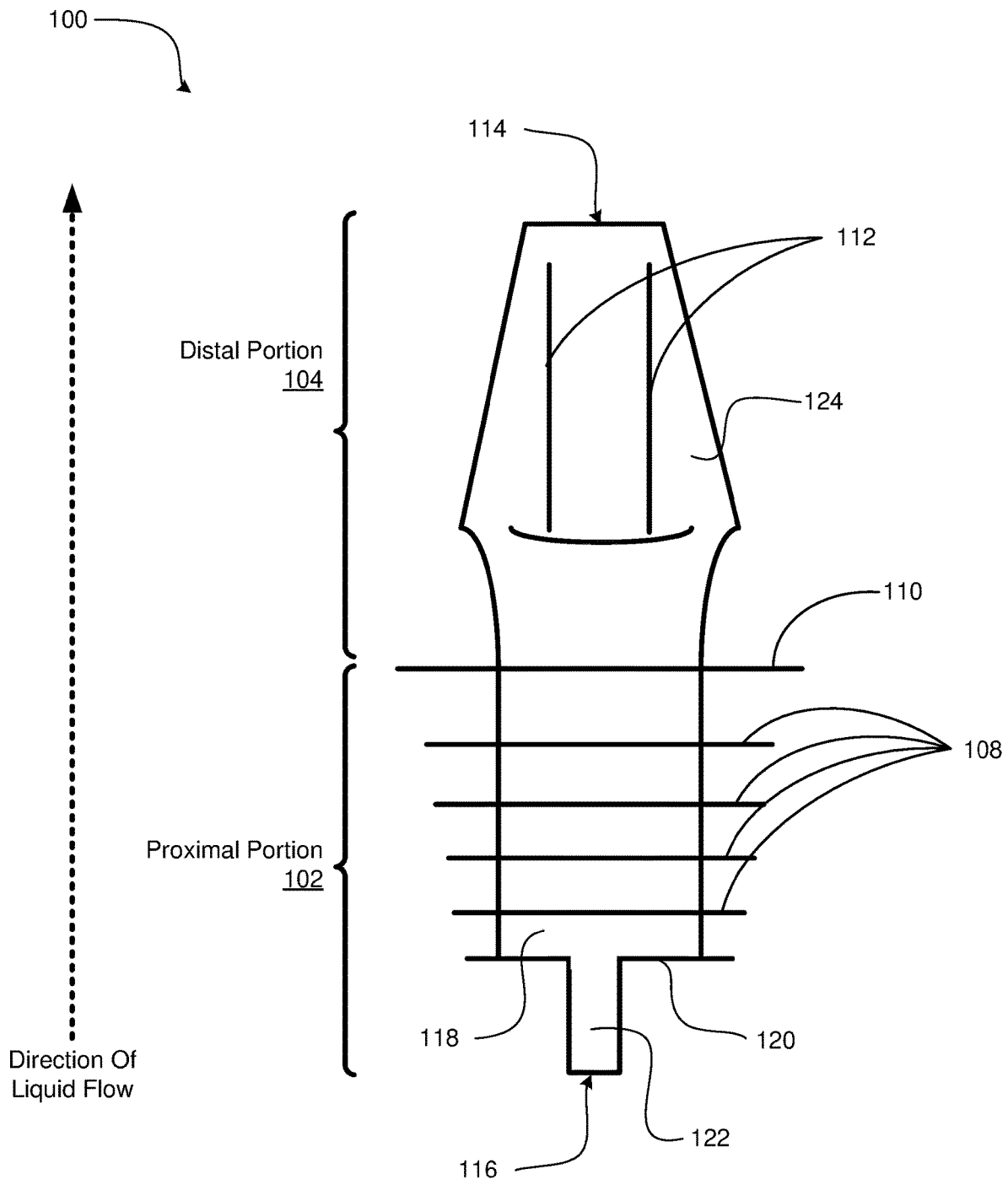
FIG. 1 is a schematic illustration of a straight-on side view of a flexible pour spout.

Disclosed herein are systems, methods, and devices for controlling and adjusting the volumetric flow rate of a liquid. Specifically described herein is a flexible pour spout to be used in connection with a container for holding a liquid. The flexible pour spout described herein enables a user to control and adjust the volumetric flow rate of a liquid when dispensing the liquid from the container through a gravity-fed dispensing configuration.

The flexible pour spouts described herein enable precision pouring and provide greater control over the volumetric flow rate of a liquid. This allows users to dispense a desired amount of liquid more accurately, and further prevents spills or splashes. This allows for consistent portion control, which makes it easier to measure and pour specific quantities of liquids. The flexible pour spouts described herein further prevent contamination of liquids by keeping foreign objects, dust, and debris out of the liquid container. This reduces the risk of cross-contamination when pouring from one container to another. The flexible pour spouts described herein additionally allow for aeration of the liquid as the liquid is poured, which can enhance the flavor and aroma of certain beverages.

The flexible pour spout described herein includes a proximal portion that is configured to be disposed within an opening of a container. The flexible pour spout additionally includes a distal portion that is configured to be located outside the container when the proximal portion is inserted into the opening of the container. The proximal portion includes a body defined by a sidewall, wherein the sidewall comprises a cylindrical or tapered cylindrical geometry. The proximal portion includes a plurality of circumferential sealing rings attached to the sidewall and extending outward relative to the sidewall. The circumferential sealing rings are configured to form a water-tight seal with the opening of the container. The proximal portion additionally includes a proximal base that guides a flow of fluid into an initial opening.

In the following description of the disclosure, reference is made to the accompanying drawings, which form a part hereof, and in which is shown by way of illustration specific implementations in which the disclosure may be practiced. It is understood that other implementations may be utilized, and structural changes may be made without departing from the scope of the disclosure.

Before the methods, systems, and devices for dispensing liquids from flexible pour spouts are disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular implementations only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the phrase "consisting of" and grammatical equivalents thereof exclude any element, step, or ingredient not specified in the claim.

As used herein, the phrase "consisting essentially of" and grammatical equivalents thereof limit the scope of a claim to the specified materials or steps and those that do not materially affect the basic and novel characteristic or characteristics of the claimed disclosure.

Referring now to the figures, FIG. 1 is a schematic illustration of a front view of a pour spout 100. The pour spout 100 is constructed of a flexible material and enables precise control over the volumetric flow rate of a liquid.

The pour spout 100 includes a proximal portion 102 and a distal portion 104. The proximal portion 102 is configured to be disposed without the opening of a container and form a water-tight seal against the opening of the container. The distal portion 104 is configured to be located outside the container when the proximal portion 102 is inserted into the opening of the container.

The proximal portion 102 is configured to be securely and releasably disposed within the opening of a container. The proximal portion 102 includes a body defined by a proximal sidewall 118. The proximal sidewall 118 is formed into a cylindrical geometry or a tapered cylindrical geometry. In the example illustrated in FIG. 1, the proximal sidewall 118 forms a hollow cylindrical shape, such that the proximal sidewall 188 comprises a cylindrical geometry.

The proximal portion 102 includes a collar 110 attached to an exterior side of the proximal sidewall 118, wherein the collar 110 is located at a distal-most end of the proximal portion 102. The collar 110 is configured to prevent the pour spout 100 from being depressed entirely into the container, and instead ensures the pour spout rests at the opening of the container. The collar 110 is further configured to form a water-tight seal against the opening of the container. The dimensions of the collar 110 are optimized to ensure a liquid-tight seal when the pour spout 100 is installed within the spout of a container.

The proximal portion 102 includes a plurality of circumferential sealing rings 108 attached to the exterior side of the proximal sidewall 118. The plurality of circumferential sealing rings 108 protrude outward relative to the exterior wall of the proximal sidewall 118. The circumferential sealing rings 108 are configured to form a liquid-tight seal against the interior wall of the opening of the container when the pour spout 100 is installed in the opening of the container. In some implementations, the circumferential sealing rings 108 may be rigid, while in other implementations, the circumferential sealing rings 108 have varying degrees of flexibility.

The proximal portion 102 additionally includes a proximal base 120. The proximal base 120 is attached to the proximal sidewall 118 at a proximal-most end of the proximal sidewall 118. The proximal base 120 additionally protrudes outward relative to the proximal sidewall 118 to aid in forming a water-tight seal against the opening of a container.

The proximal portion 102 further includes a conduit 122. The hollow conduit 122 permits fluid to flow from the associated container and into the pour spout 100. The conduit 122 is attached to the proximal base 120 such that liquids located within the container enter the pour spout 100 through the conduit 122. The conduit 122 defines an initial opening 116 to the pour spout 100. The initial opening 116 is a negative space disposed within the hollow conduit 122 wherein a liquid can pass from the container into the pour spout 100.

The distal portion 104 is located outside the container when the proximal portion 102 of the pour spout 100 is installed within the opening of the container.

The distal portion 104 includes a body defined by a distal sidewall 124. The distal sidewall 124 is formed into a substantially cylindrical geometry or a substantially tapered cylindrical geometry. In the example illustrated in FIG. 1, the distal sidewall 124 forms a hollow tapered cylindrical shape, such that the distal sidewall 124 comprises a substantially tapered cylindrical geometry.

The distal sidewall 124 defines a terminal opening 114 of the pour spout 100. The terminal opening 114 is the opening wherein liquid will exit the pour spout. Thus, liquid flows from the container, and then into the proximal portion 102 of the pour spout 100, and then into the distal portion 104 of the pour spout 100, and then out of the pour spout 100 through the terminal opening 114.

The distal portion 104 includes one or more bends 112 formed into the distal sidewall 124. The bends 112 prevent the distal sidewall 124 from having a perfectly cylindrical geometry or a perfectly tapered cylindrical geometry. Thus, due to the bends 112, the distal sidewall 124 comprises a substantially cylindrical geometry or a substantially tapered cylindrical geometry. The bends 112 consist of formations made into the distal sidewall 124, and the configuration of the bends 112 determines the cross-sectional geometry of the terminal opening 114. The bends 112 provide increased flexibility to pour spout 100 and enable a user to control the volumetric flow rate of fluid through the terminal opening.

The bends 112 are configured improve the flexibility of the distal portion 104 such that a user may apply a pressure to the distal sidewall 124 to variably close or open the terminal opening 114. When a user applies a pressure to the distal sidewall 124, the distal sidewall 124 naturally depresses at the bends 112. When the distal sidewall 124 depresses at the bends 112, the cross-sectional geometry of the terminal opening 114 is adjusted, and the overall size of the terminal opening 114 is reduced. Thus, a user may slow the volumetric flow rate of fluid through the terminal opening 114 by depressing the distal sidewall 124 and causing the distal portion 104 to depress along the bends 112.

Figure 2:
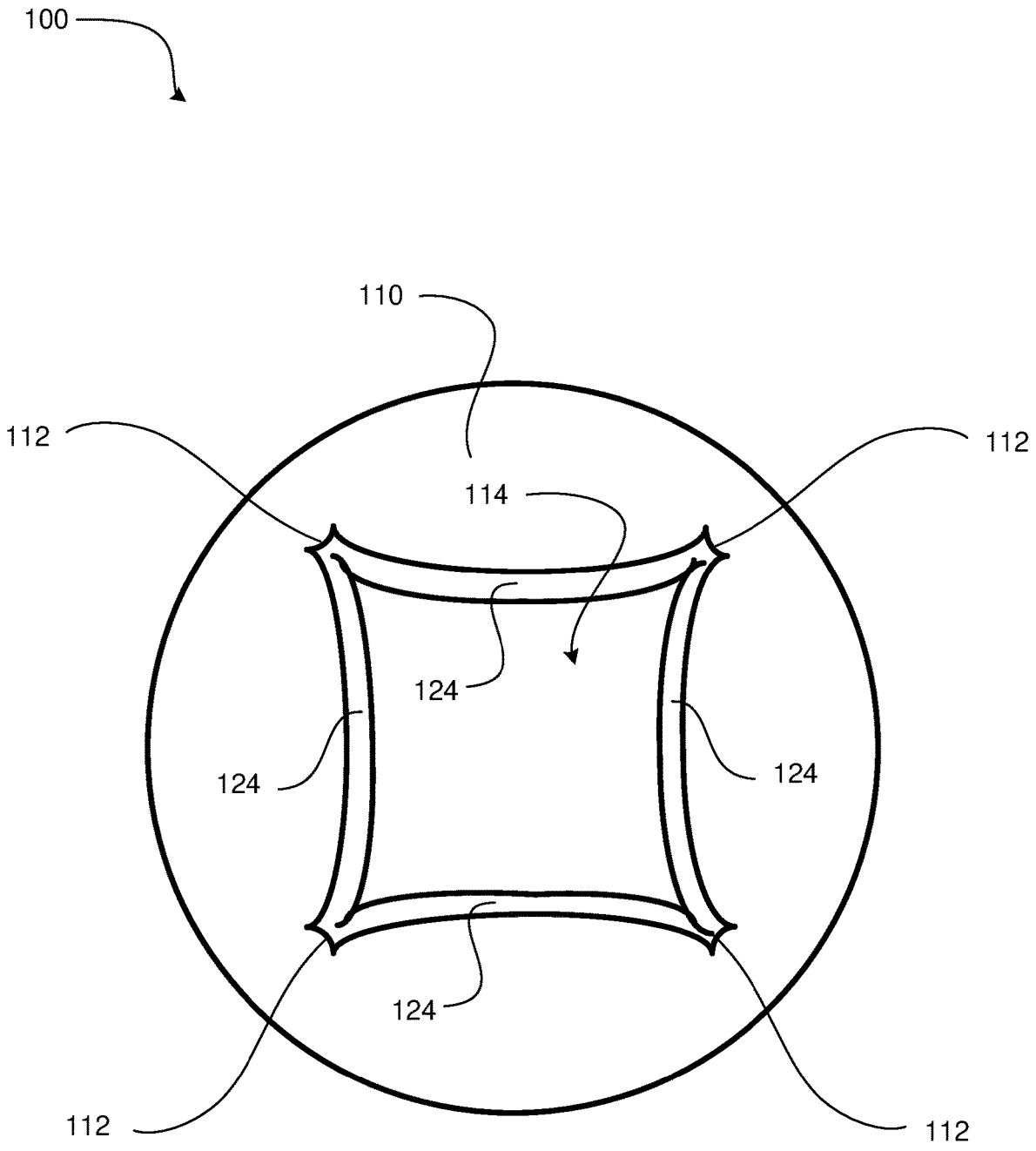
FIG. 2 is a schematic illustration of top-down aerial view of a flexible pour spout.

FIG. 2 is a schematic illustration of an overhead view of the pour spout 100. As seen from overhead, the plurality of bends 112 define a terminal opening 114 to the pour spout 100. In the example illustrated in FIG. 2, the distal portion 104 includes four bends 112 integrated into the distal sidewall 124. These four bends 112 cause the distal sidewall 124 to form a substantially quadrilateral cross-sectional geometry, and thus, the terminal opening 114 has a substantially quadrilateral cross-sectional geometry. One skilled in the art will appreciate other numbers and configurations of bends 112 may be used in other implementations of the pour spout 100.

The collar 110 of the proximal portion 102 is visible in the top-down view. The size and geometry of the collar 110 is designed to form a liquid-tight seal against the spout of the associated container when the pour spout 100 is in use.

Figure 3:
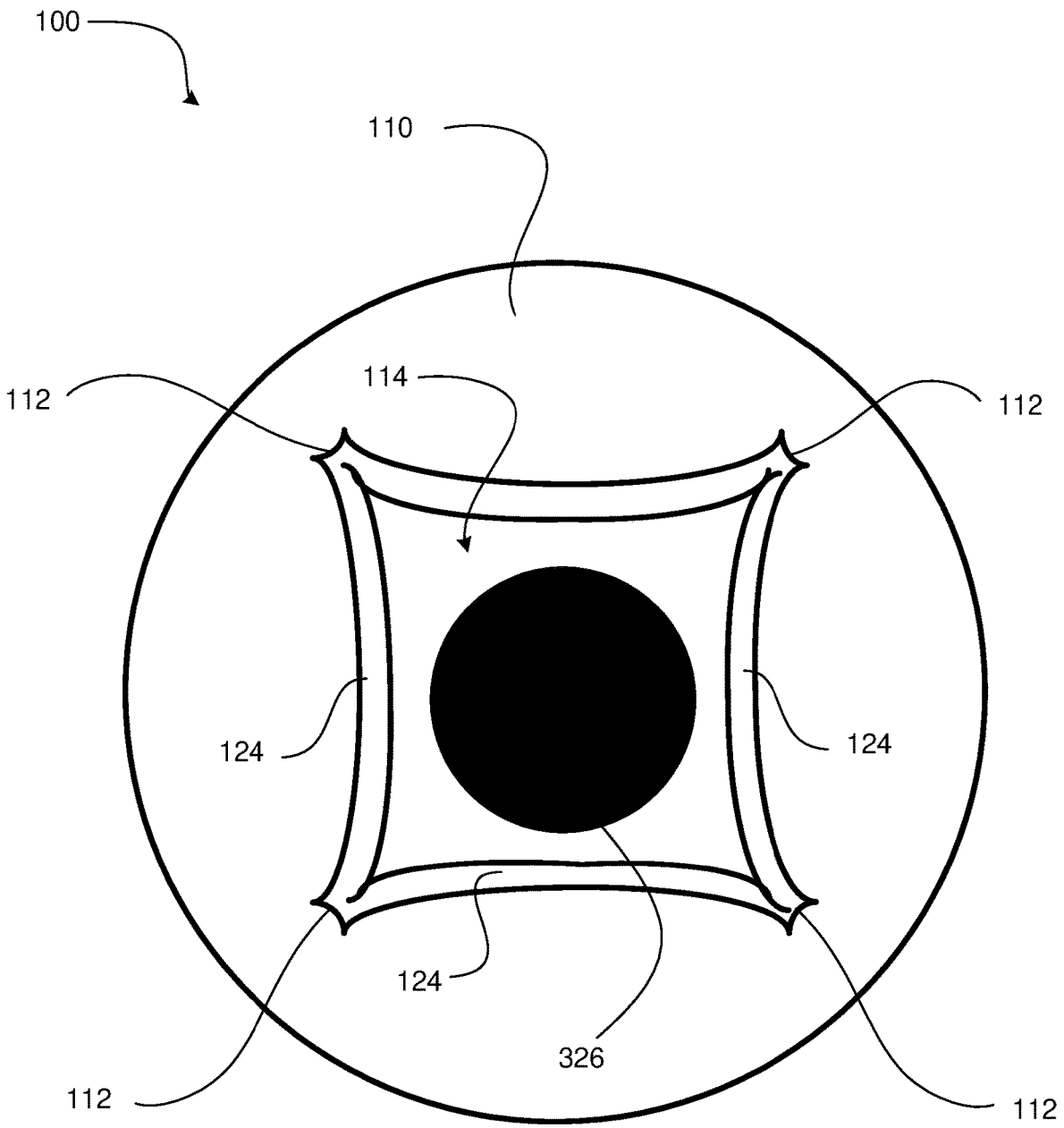
FIG. 3 is a schematic illustration of top-down aerial view of a flexible pour spout.

FIG. 3 is a schematic illustration of an overhead view of the pour spout 100. The pour spout 100 illustrated in FIG. 3 further includes an internal seal 326 that is visible through the terminal opening 114. The internal seal 326 prevents the flow of fluid through the terminal seal 114 when no pressure is applied to the distal sidewall 124 to put the pour spout 100 into a "pouring configuration."

Figure 4A:
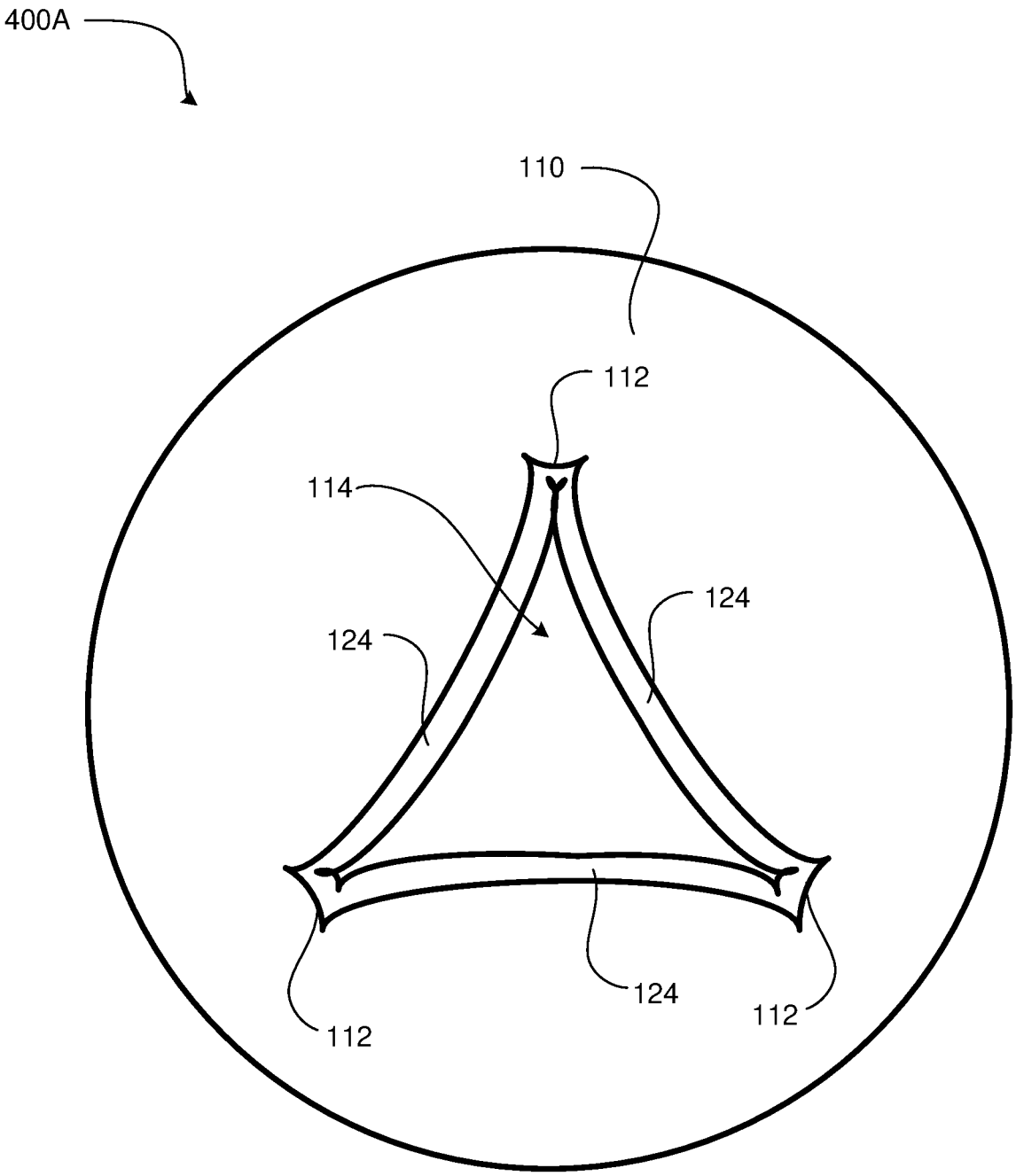
FIG. 4A is a schematic illustration of top-down aerial view of a flexible pour spout.
Figure 4B:
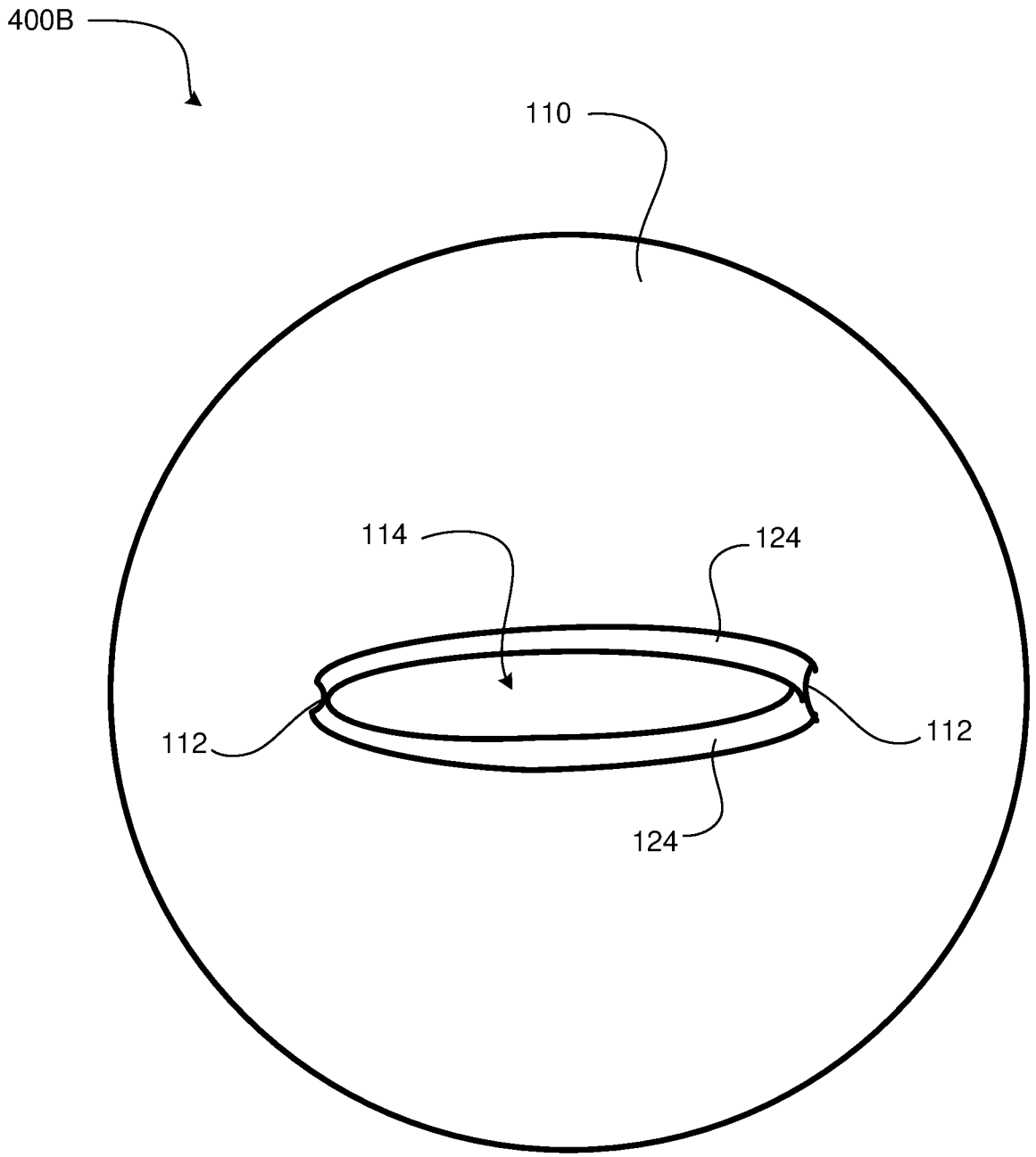
FIG. 4B is a schematic illustration of top-down aerial view of a flexible pour spout.
Figure 4C:
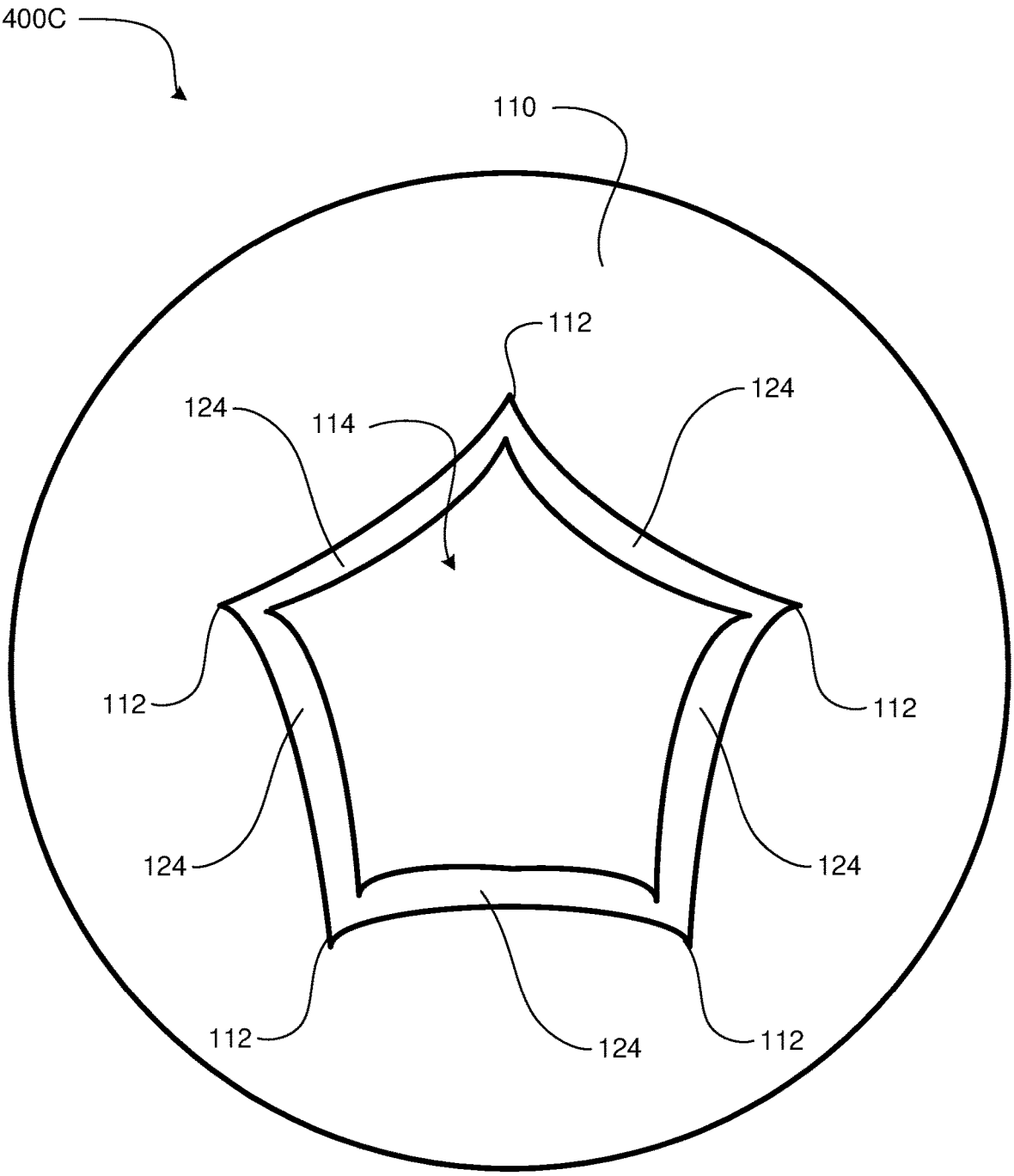
FIG. 4C is a schematic illustration of top-down aerial view of a flexible pour spout.

FIGS. 4A-4C are schematic illustrations of overhead views of the pour spout described herein, with alternate bend configurations when compared with the pour spout 100 first discussed in connection with FIG. 1. FIG. 4A is a schematic illustration of an overhead view of a pour spout 400A including three bends 112 such that the distal sidewall 124 and terminal opening 114 comprise a substantially triangular cross-sectional geometry. FIG. 4B is a schematic illustration of an overhead view of a pour spout 400B including two bends 112 such that the distal sidewall 124 and terminal opening 114 comprise a substantially two-sided or elliptical cross-sectional geometry. FIG. 4C is a schematic illustration of an overhead view of a pour spout 400C including five bends 112 such that distal sidewall 124 and the terminal opening 114 comprise a substantially pentagonal cross-sectional geometry.

The exemplary implementations shown herein are not intending to be limiting and other configurations of differing numbers of bends forming other bend configurations are contemplated.

Figure 5:
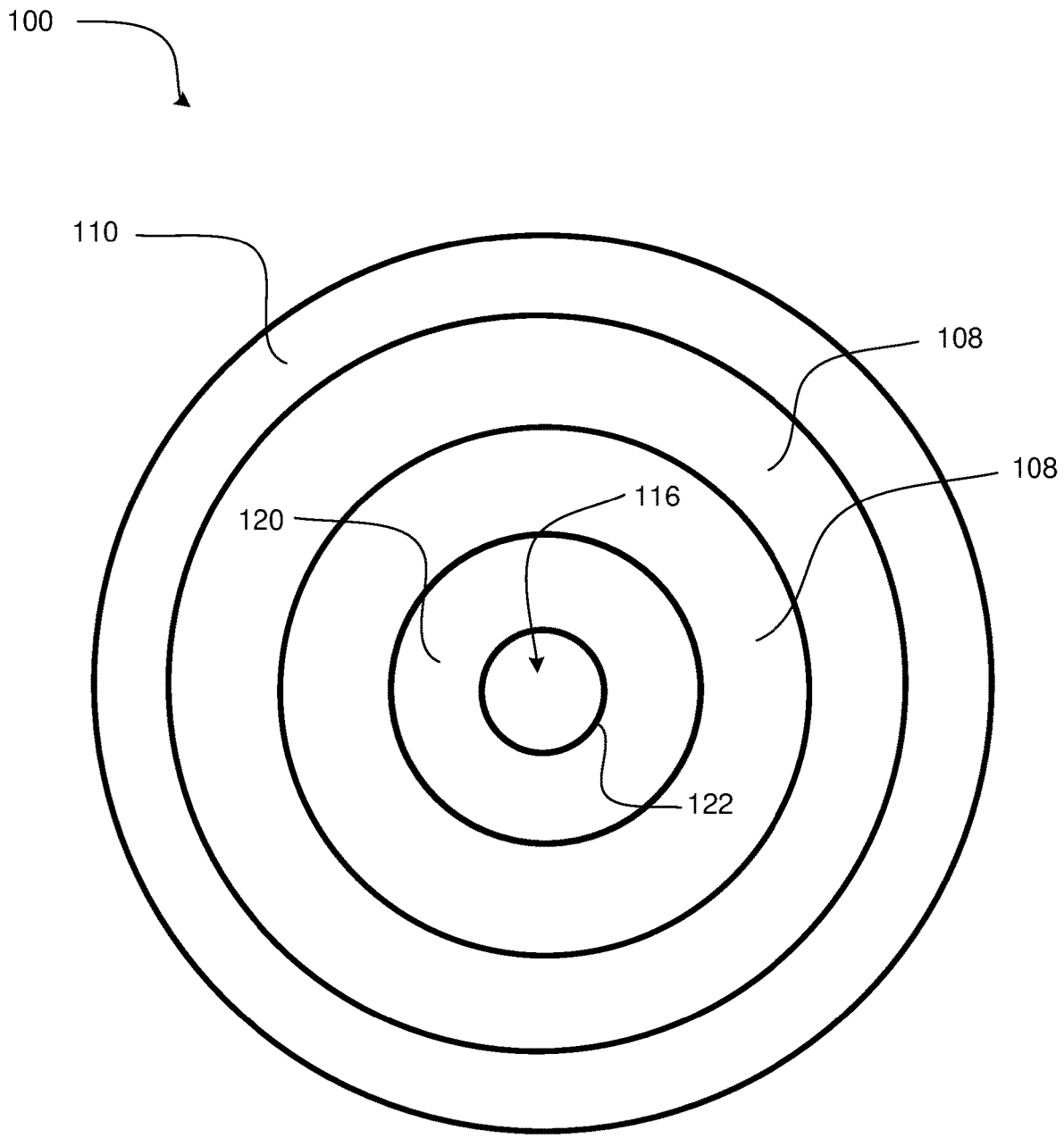
FIG. 5 is a schematic illustration of a bottom-up underside view of a flexible pour spout.

FIG. 5 is a schematic illustration of a bottom-up underside view of the pour spout 100. As shown in FIG. 5, the collar 110 and several of the circumferential sealing rings 108 are visible from the underside of the pour spout 100. Additionally, proximal base 120 is visible and the negative air space defined by the initial opening 116 is visible. The wall of the conduit 122 is visible, and it can be seen that the wall of the hollow conduit 122 forms the space for the initial opening 116. The hollow interior space defined by the conduit 122 is the fluid passageway for the pour spout 100. The fluid passageway permits fluid to flow from the associated container into the pour spout 100.

The one or more circumferential sealing rings 108 may be uniformly sized in some implementations, while in others they may be differently sized. In such implementations the one or more circumferential sealing rings 108 may be sized such that each successive circumferential sealing ring 108 along the proximal portion 102 is larger than the one before up to the collar 110. The collar 110 may be largest in diameter in comparison to each of the plurality of circumferential sealing rings 108 in some implementations, while in others the collar 110 may be evenly sized with the plurality of circumferential sealing rings 108.

Figure 6:
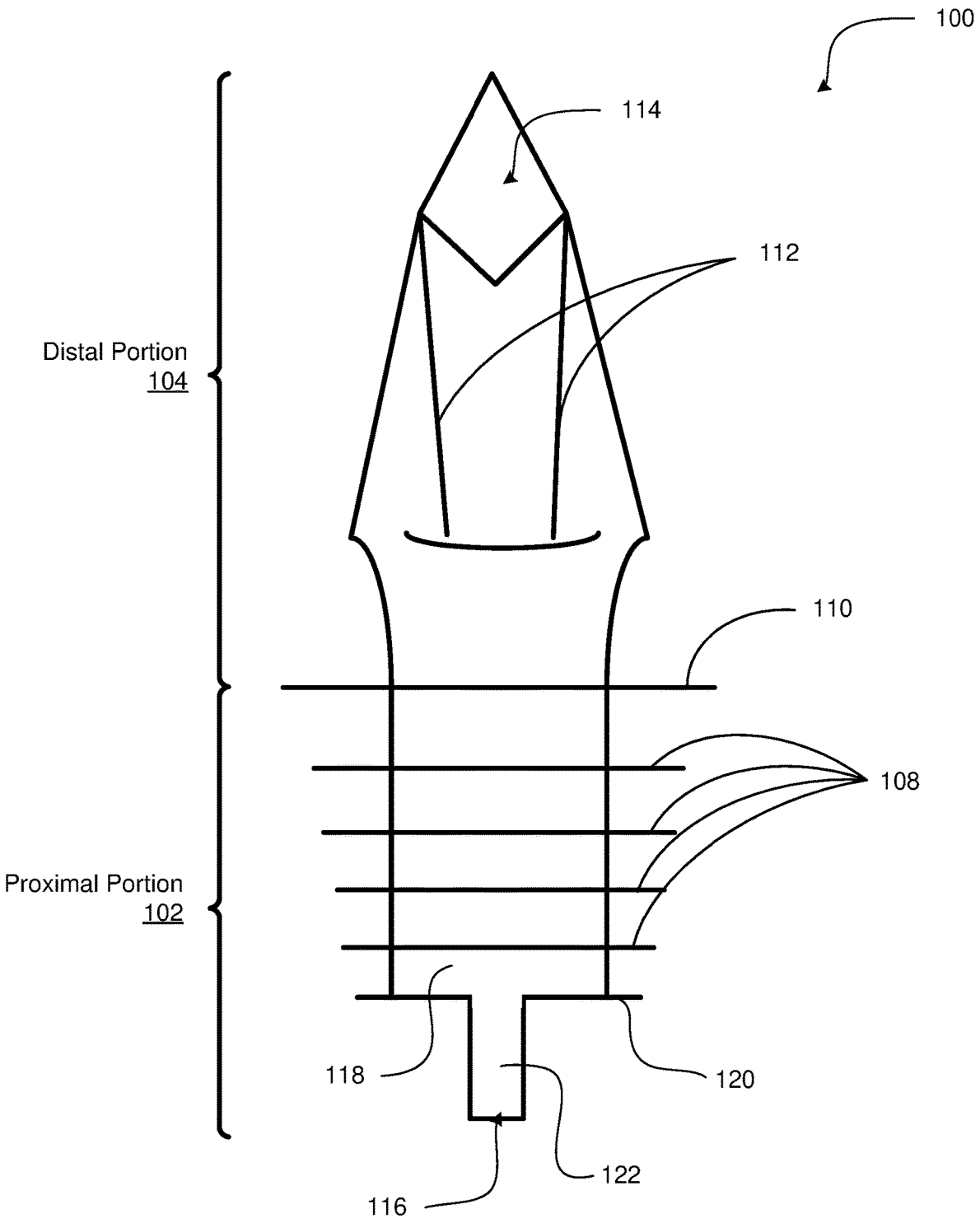
FIG. 6 is a schematic illustration of a straight-on side view of a flexible pour spout in a pouring configuration with a pressure applied to a distal portion sidewall.

FIG. 6 is a schematic illustration of a straight-on side view of the pour spout 100, wherein the pour spout 100 is manipulated into a pouring configuration. The plurality of bends 112 may be flexible such that a user may manipulate them into various positions. The user may apply pressure with their hand or another suitable implement to apply force to the pour spout 100 to manipulate the plurality of bends 112. The plurality of bends 112 may be spaced, angled, and otherwise positioned such that when pressure is applied, they may "bend" upon one another. A user may manipulate these bends to restrict the terminal opening 118 of the distal portion 104 to control the flow, angle, etc. of a liquid being poured through the pour spout 100. The size and shape of the terminal opening 118 may be influenced by the number of bends 112 present in the particular implementation of the pour spout 100 and by how much force or pressure is applied by the user.

Figure 7:
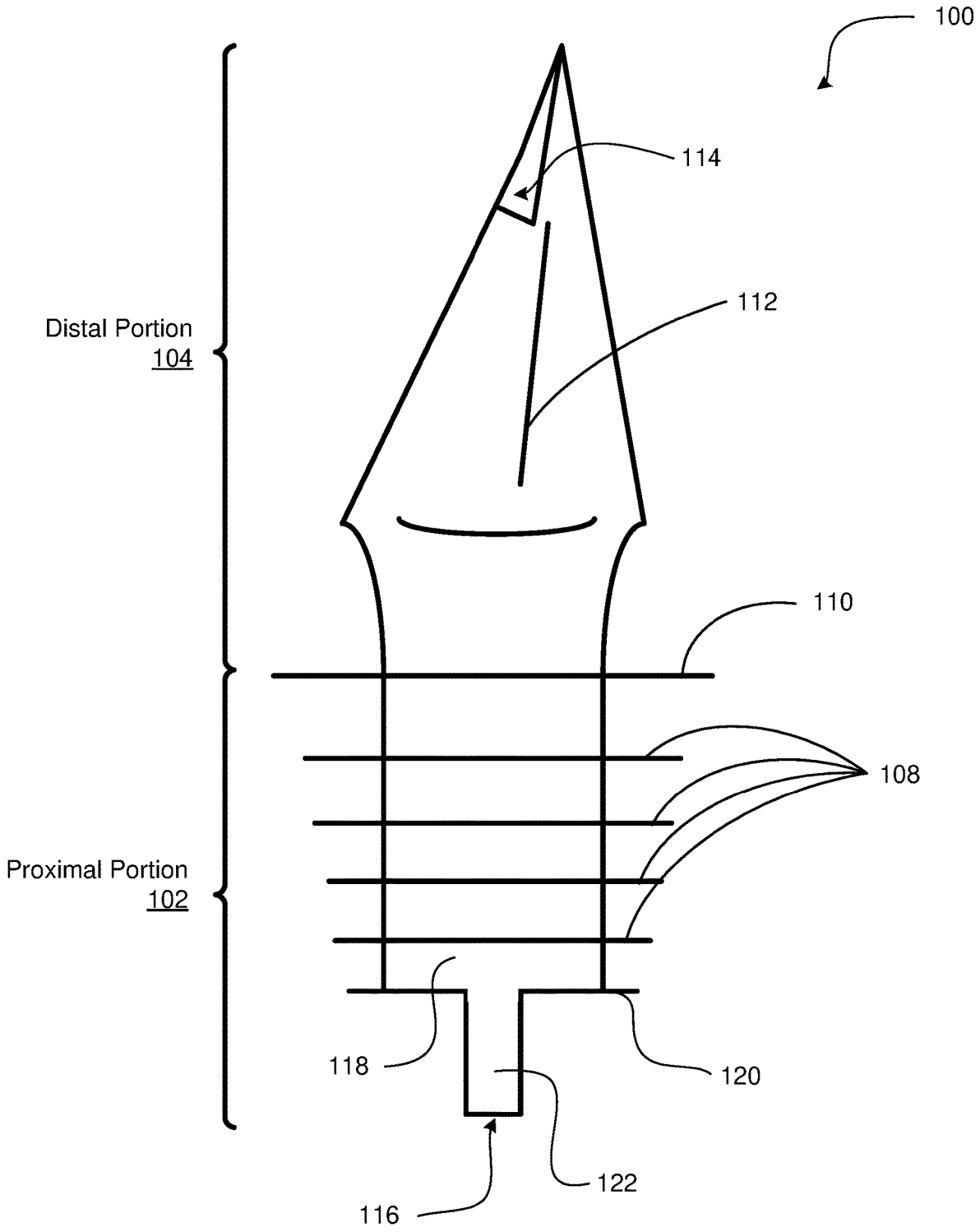
FIG. 7 is a schematic illustration of a straight-on side view of a flexible pour spout in a pouring configuration with a pressure applied to a distal portion sidewall.

FIG. 7 is a schematic illustration of a straight-on side view of the pour spout 100, wherein the pour spout 100 is manipulated into a pouring configuration. When force or pressure is applied to the spout 100 to manipulate the spout 100 into a pouring configuration the distal portion 104 of the spout 100 angles in the direction of the force. The plurality of bends 112 are positioned such that they bend inward upon one another to facilitate shaping into the pouring configuration. In some implementations, the plurality of bends 112 may retain the manipulated shape even once pressure or force is removed. In other implementations, the plurality of bends 112 may simply revert to a neutral position.

Figure 8:
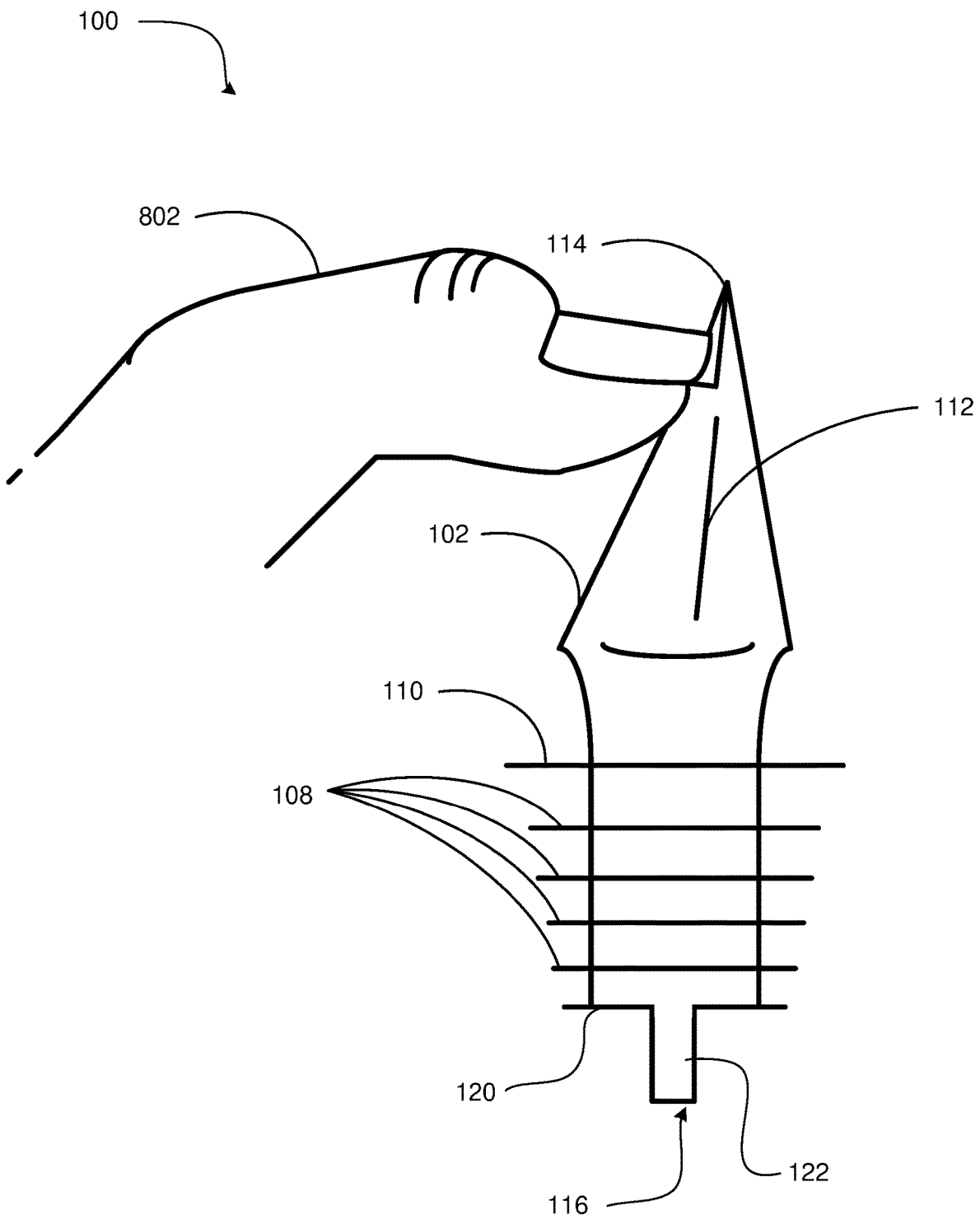
FIG. 8 is a schematic illustration of a straight-on side view of a flexible pour spout in a pouring configuration with a pressure applied to a distal portion sidewall.

FIG. 8 is a schematic illustration of a straight-on side view of the pour spout 100, wherein the pour spout 100 is manipulated into a pouring configuration by a user. Shown here, an implement 802 depicted as, in a non-limiting example, a thumb, applies pressure to manipulate the pour spout 100 into the pouring configuration. The plurality of bends 112 may be constructed to varying degrees of flexibility, such that more or less pressure may be required to manipulate the bends 112 according to a user's needs. While the implement 802 shown in the figure is depicted as a thumb, one of ordinary skill in the art will appreciate other fingers or tools may be used to manipulate the bends 112. Additionally, other implements such as a clamp, clothespin, rubber band, or similar implement may be utilized to hold a pour spout 100 in its manipulated configuration.

Figure 9:
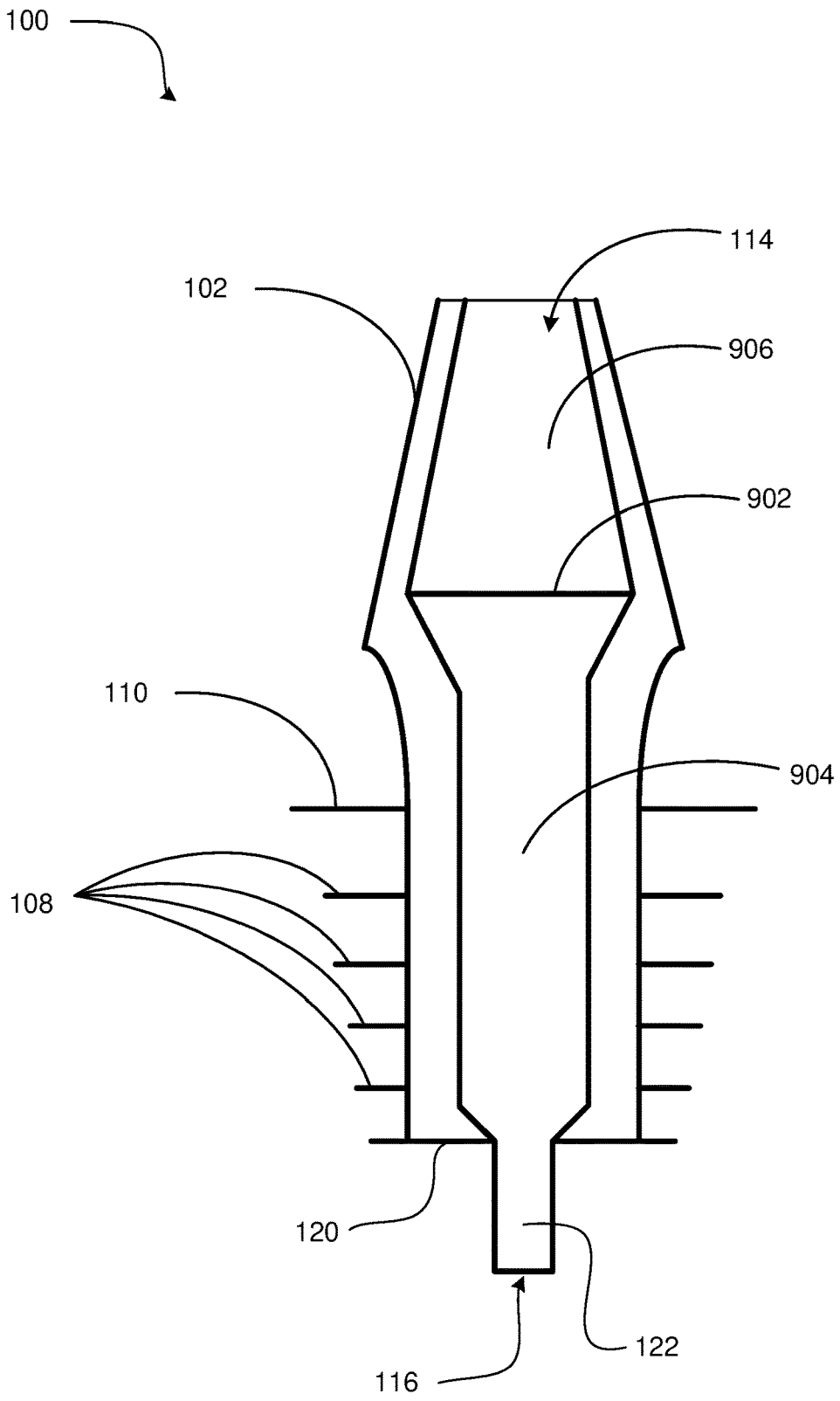
FIG. 9 is a schematic illustration of a cross-sectional straight-on side view of a flexible pour spout.

FIG. 9 is a schematic illustration of a cross-sectional straight-on side view of the pour spout 100. In some implementations, the pour spout 100 includes two internal cavities, including a first cavity 904 and a second cavity 906. The first cavity 904 and the second cavity 906 are separated by an internal seal 902. In some implementations, the first cavity 904 and the second cavity 906 are uniformly sized. In other implementations, the first cavity 904 and the second cavity 906 have different dimensions according to a user's needs. The first cavity 904 may be longer in relation to the second cavity 906 as shown in FIG. 9. Additionally, the second cavity 906 may be wider on one end and taper towards a narrower end at the terminal opening 114 as shown in FIG. 9.

The internal seal 902 may be made from the same material or different material of the pour spout 100 as a whole. That is to say, in some implementations, the internal seal 902 may be made with the rest of the pour spout 100 as a single piece of construction. In some implementations, the internal seal 902 may be added to the pour spout 100 as an additional piece. The internal seal 902 may be made from the same material as the rest of the pour spout 100 or a different material. The internal seal 902 may be a single piece, or multiple pieces disposed in such a way as to form the seal such it resists liquid flowing through. In FIG. 9, the internal seal 902 is depicted as being disposed within the distal portion of the pour spout 100 as a non-limiting example. In other implementations, an internal seal 902 may be disposed within the proximal portion 102 of the pour spout 100.

Figure 10:
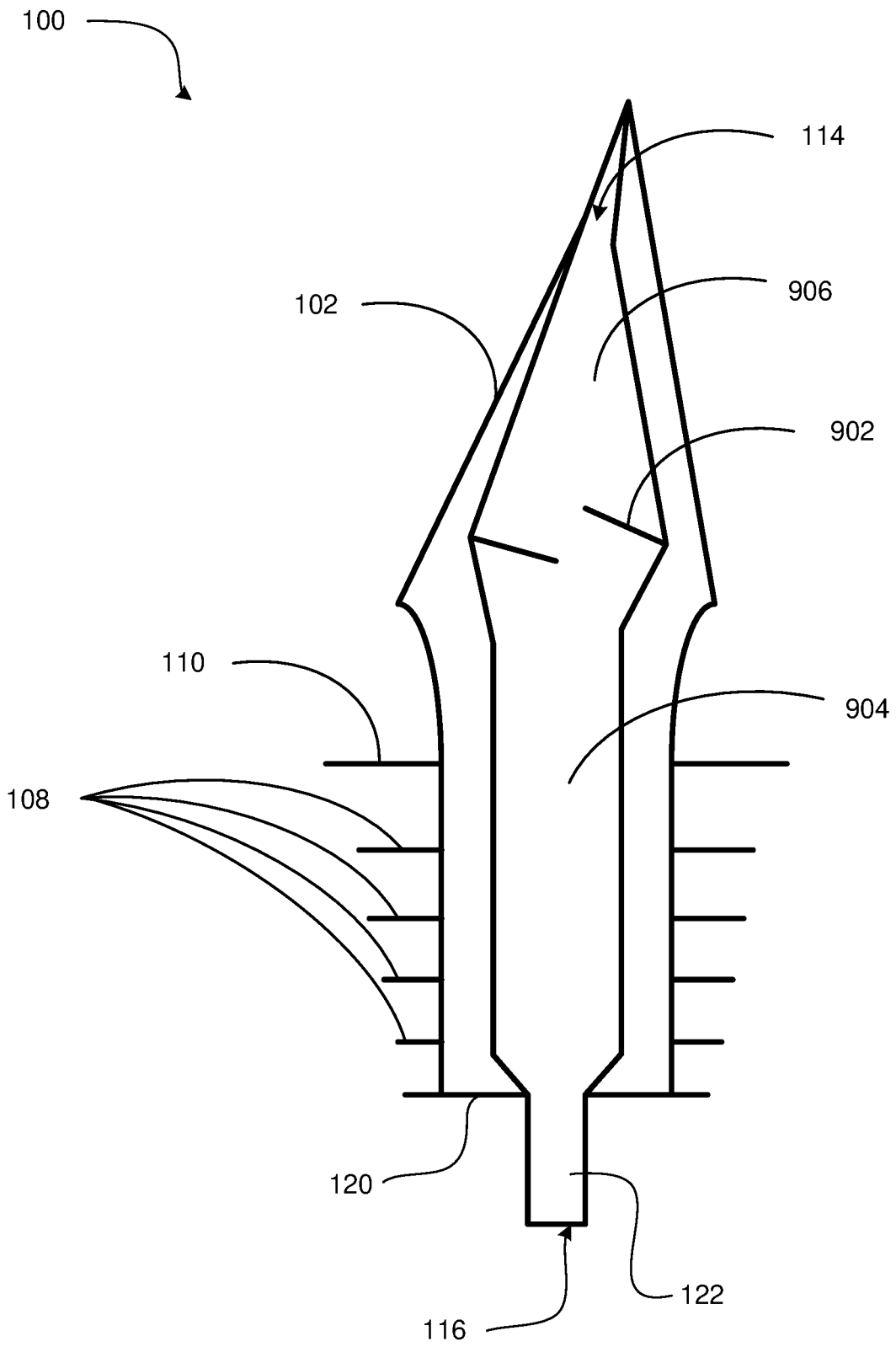
FIG. 10 is a schematic illustration of a cross-sectional straight-on side view of a flexible pour spout in a pouring configuration with a pressure applied to a distal portion sidewall.

FIG. 10 is a schematic illustration of a cross-sectional straight-on side view of the pour spout 100. When manipulated by flexing the distal portion, the internal seal 902 may "break" or otherwise separate to join the spaces of the first cavity 904 and second cavity 906 into a single contiguous space. Such a space may allow a liquid to flow from the hollow conduit 122 through the first cavity 904 and the second cavity 906 to exit through the terminal opening 114. In FIG. 10, as a non-limiting example, the internal seal 902 is shown as being formed from two pieces that "break" in the center of the internal seal 902 relative to either end of the pour spout 100. In other implementations, the internal seal 902 may be comprised of more or less pieces than shown and may "break" or otherwise open in a unique way to facilitate liquid flowing through the pour spout 100 once force or pressure is applied to manipulate the pour spout 100 into a pouring configuration.

Figure 11:
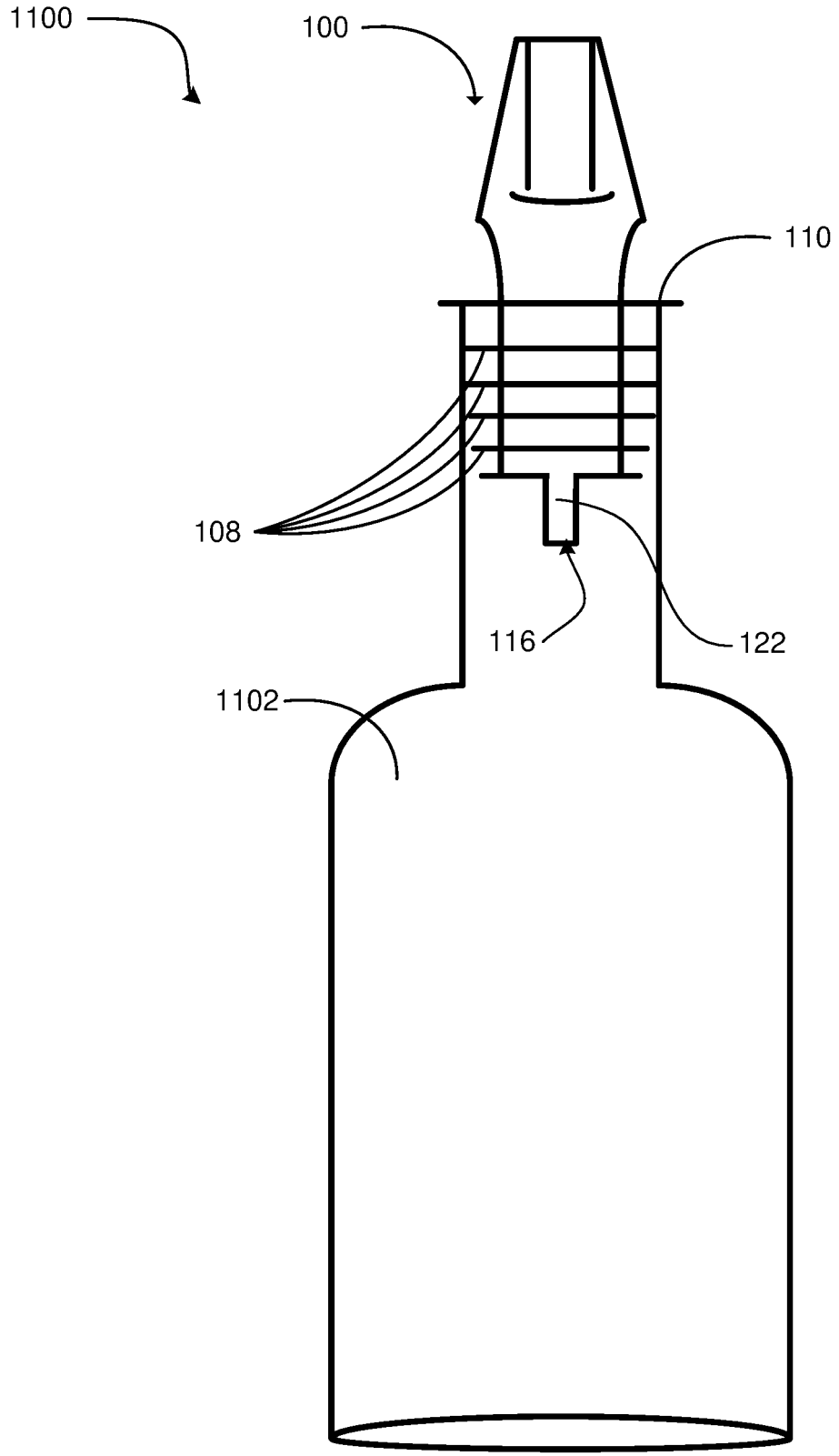
FIG. 11 is a schematic illustration of a pouring system including a flexible pour spout and a container, wherein a proximal portion of the flexible pour spout is inserted into an opening of the container.
Figure 12:
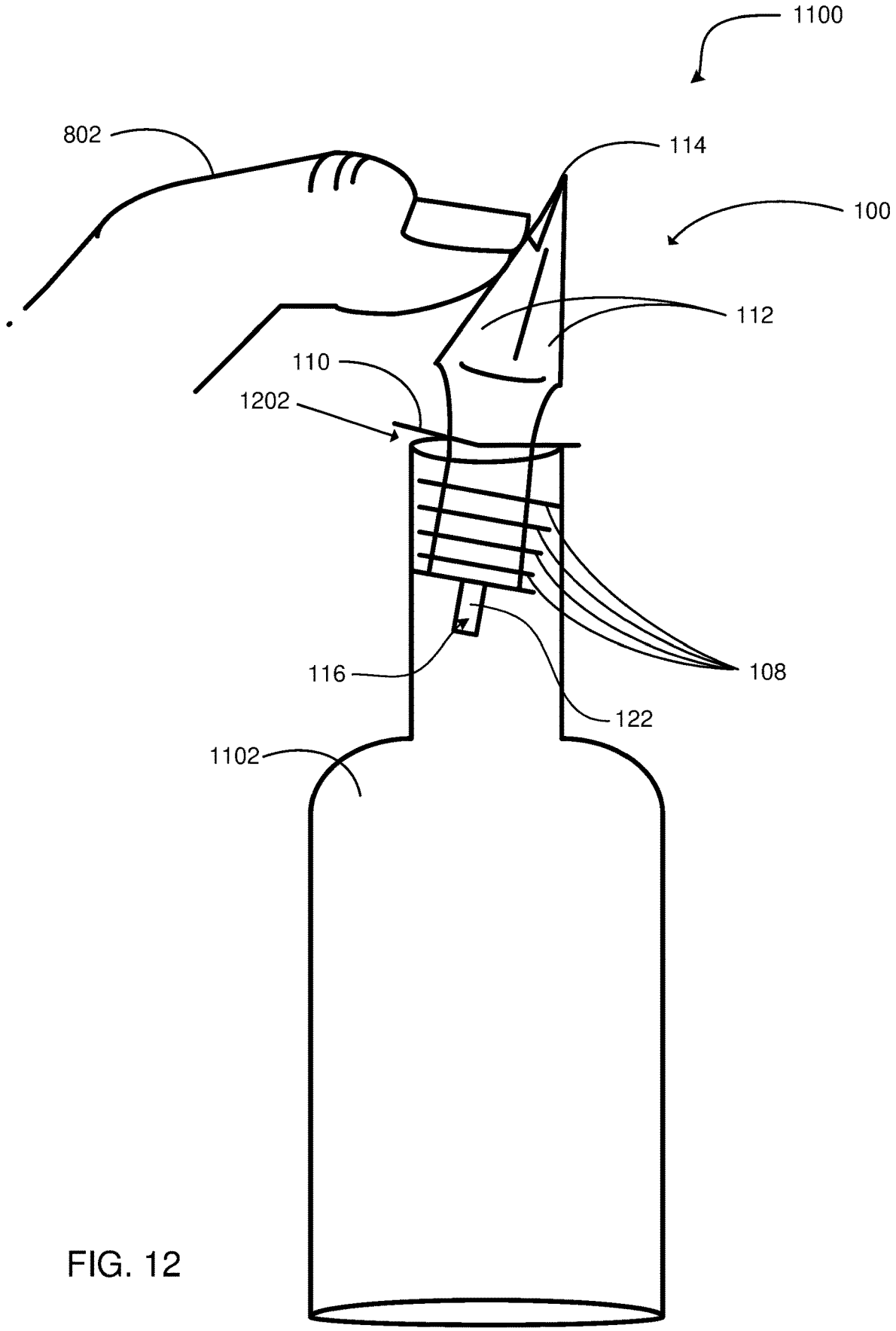
FIG. 12 is a schematic illustration of a pouring system including a flexible pour spout and a container, wherein a proximal portion of the flexible pour spout is inserted into an opening of the container, and wherein the flexible pour spout is in a pouring configuration with a pressure applied to a distal portion sidewall.

FIGS. 11 and 12 are schematic illustrations of a side view of a flexible funnel spout system 1100 comprising a pour spout 100 disposed within a container 1102 and being manipulated into a pour configuration. Shown in FIG. 12, the pour spout 100 is receiving pressure from an implement 802 causing the bends 112 of the distal portion 104 to form a pouring configuration shape. While the implement 802 is shown here as a thumb by way of example, any other finger of a user or other tool suitable for applying a force or pressure may be used to manipulate the pour spout 100 into a pouring configuration shape. For example, a user may utilize a push tool like the handle of another implement to apply pressure, or may use a mechanism like a clothespin, a rubber band, or another implement to hold a pour spout 100 in a pouring configuration shape.

Once in a pouring configuration shape, the collar 110 of the pour spout 100 may partially lift and detach from being flush with the opening of the container 1102. The collar 110 may lift to sufficiently to create an airflow passage 1202 may form. The airflow passage 1202 provides sufficient space for air to flow into or out of the container 1102. The plurality of circumferential sealing rings 108 may be spaced such that air may enter the container 1102 through airflow passage 1202 and allow sufficient airflow to pour liquid from the container and out of the pour spout 100, while restricting the ability of liquid to pour out of the airflow passage 1202 formed by the raised collar 110.

Figure 13:
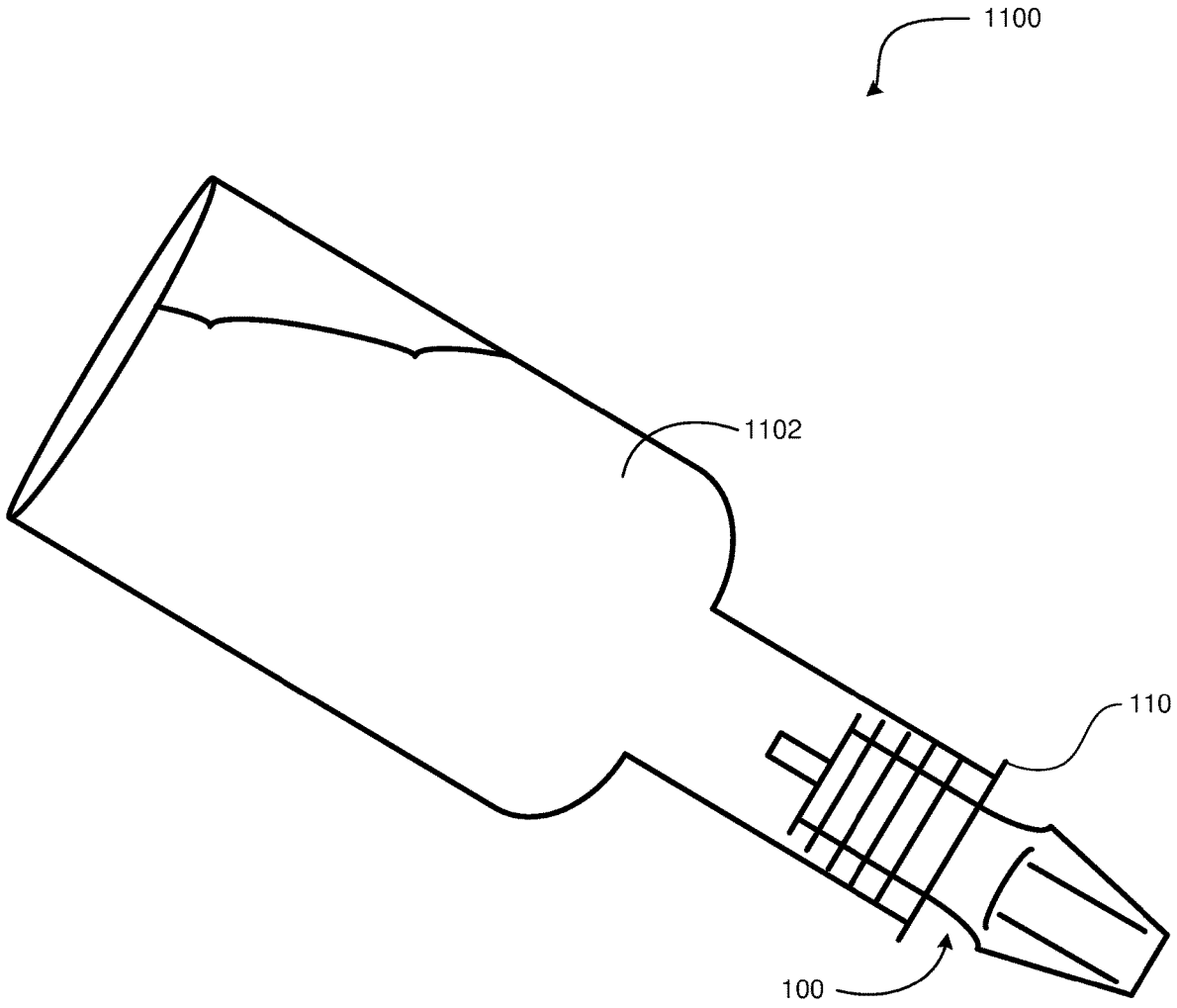
FIG. 13 is a schematic illustration of a pouring system including a flexible pour spout and a container, wherein a proximal portion of the flexible pour spout is inserted into an opening of the container, and wherein the container is tipped.

FIG. 13 is a schematic illustration of the flexible funnel spout system 1100 comprising the pour spout 100 disposed within the container 1102 when the container 1102 is tilted upside down. As shown, the pour spout 100 is disposed within the container 1102 such that the collar 110 forms a seal that prevents airflow into the container 1102 and prevents liquid from escaping. The internal seal (see 902 first illustrated in FIG. 9) prevents liquid from pouring through the pour spout 100. The plurality of circumferential sealing rings 108 may be sized to secure the pour spout 100 within the opening of the container 1102 and may additionally be sized to assist the collar 110 in preventing airflow into the container 1102 to prevent liquid from escaping.

Figure 14:
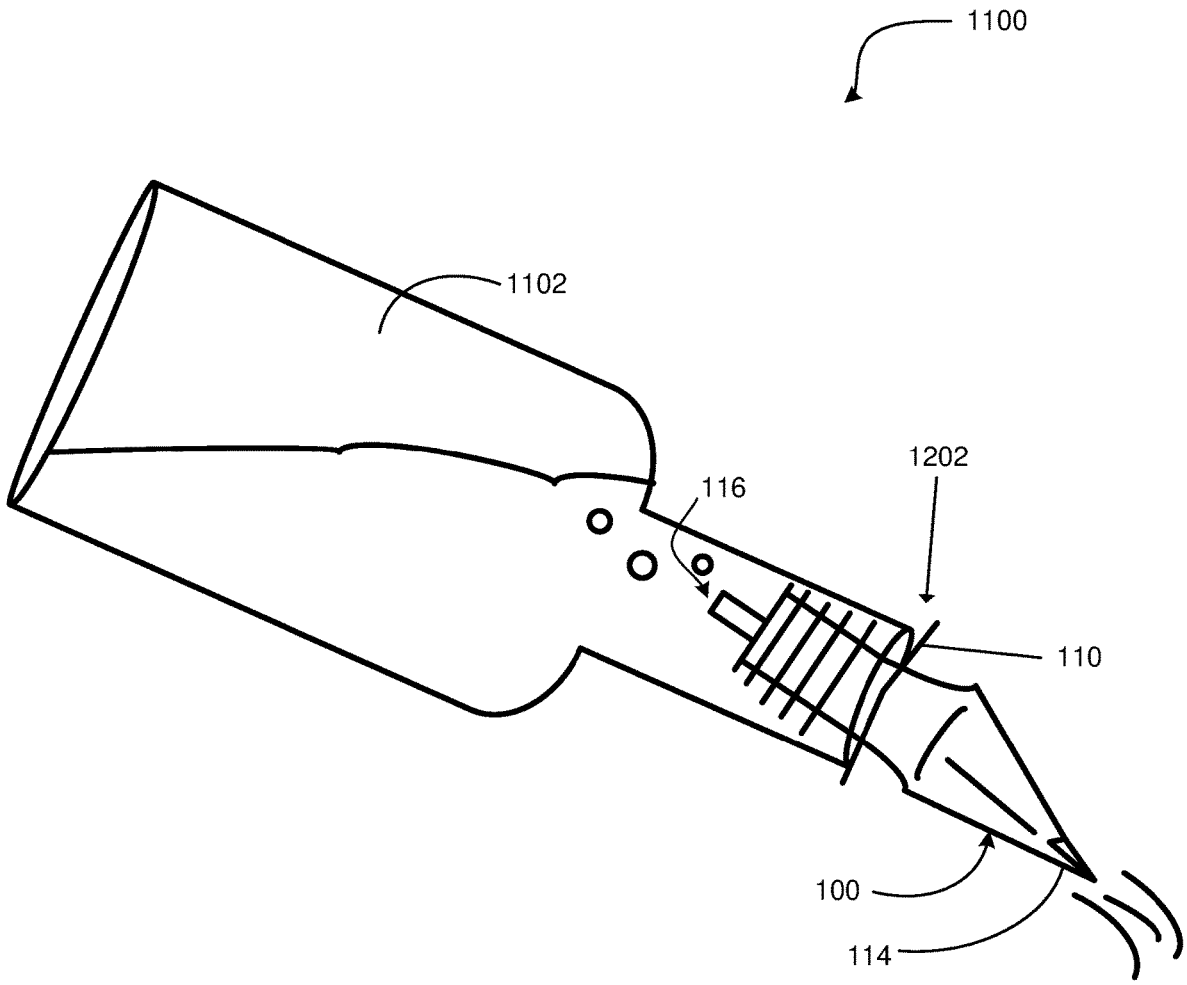
FIG. 14 is a schematic illustration of a pouring system including a flexible pour spout and a container, wherein a proximal portion of the flexible pour spout is inserted into an opening of the container, and wherein the flexible pour spout is in a pouring configuration with a pressure applied to a distal portion sidewall, and wherein the container is tipped to allow a flow of fluid through the flexible pour spout.

FIG. 14 is a schematic illustration of the flexible funnel spout system 1100 comprising the pour spout 100 disposed within the container 1102 and manipulated into a pouring configuration to pour liquid out of the container 1102. Once manipulated, the pour spout 100 may take on a shape that permits liquid to escape the container 1102. The collar 110 of the pour spout 100 may raise to such a degree to form an airflow passage 1202 that allows for airflow to enter the container. The internal seal (see 902 first illustrated in FIG. 9) may separate or "break" in a way that allows liquid to flow from the hollow conduit 122 through the pour spout 100 and out of the terminal opening 114 of the pour spout 100.

A method for utilizing a flexible pour spout device as described herein may comprise the following steps: disposing a flexible pour spout within a container, applying pressure to the plurality of bends of the flexible pour spout device, while applying pressure to the device, turning the container upside down, and pouring liquid from the container out of the flexible pour spout device.

EXAMPLES

The following examples pertain to further embodiments.

Example 1 is a device comprising an first portion and a second portion, wherein the first portion comprises a collar and a plurality of sidewalls each comprising a bend, wherein the first portion comprises a first opening defined by the plurality of bends, wherein the second portion comprises a conduit, wherein the conduit comprises a second opening, wherein the plurality of bends is configured such that the plurality of bends collapse on each other under pressure to restrict the first opening.

Example 2 is a device as in Example 1, wherein the second portion further comprises a plurality of circumferential sealing rings disposed along a length of the second portion, and wherein the plurality of circumferential sealing rings are each sequentially sized such that the ridge abutting the conduit is the smallest in diameter.

Example 3 is a device as in Examples 1 or 2, wherein the wherein the first opening and the second opening are sized such that liquid travels freely from the second opening through the first opening but is restricted from traveling from the first opening through the second opening.

Example 4 is a device as in any of Examples 1-3, wherein the plurality of circumferential sealing rings are configured to provide friction against a container opening such that the device is secured within the container opening and restricts liquid from escaping the container opening.

Example 5 is a device as in any of Examples 1-4, wherein the collar is configured to restrict the depth the device can be disposed within a container opening.

Example 6 is a device as in any of Examples 1-5, wherein the second portion is more rigid than the first portion.

Example 7 is a device as in any of Examples 1-6, wherein the conduit is narrower than the second portion.

Example 8 is a device as in any of Examples 1-7, wherein the plurality of circumferential sealing rings extend away from the second portion, and wherein the plurality of circumferential sealing rings each wrap around a circumference of the second portion.

Example 9 is a device as in any of Examples 1-8, wherein the first opening forms a diamond shape when pressure is applied, and the first opening is restricted.

Example 10 is a device as in any of Examples 1-9, wherein the collar is comprised of a rubber material such that the collar forms a seal when disposed in a container opening to prevent a liquid from escaping the container opening.

Example 11 is a pour spout. The pour spout includes a proximal portion configured to be inserted into an opening of a container, wherein the proximal portion comprises: a first sidewall defining a first internal cavity; and a collar attached to an external side of the first sidewall. The pour spout includes a distal portion configured to extend outside the container when the proximal portion is inserted into the opening of the container, wherein the distal portion comprises: a second sidewall defining a second internal cavity; and a terminal opening located at a distal end of the second sidewall. The second sidewall comprises a bend such that at least a portion of the second sidewall collapses along the bend to reduce a size of the terminal opening in response to applying a pressure to the second sidewall.

Example 12 is a pour spout as in Example 11, wherein the collar forms a liquid-tight seal against the opening of the container when the proximal portion is inserted into the opening of the container.

Example 13 is a pour spout as in any of Examples 11-12, wherein a portion of the collar detaches from the opening of the container in response to applying the pressure to the second sidewall.

Example 14 is a pour spout as in any of Examples 11-13, wherein a portion of the collar detaches from the opening of the container in response to applying the pressure to the second sidewall to generate an airflow passage in between the container and the proximal portion; and wherein the airflow passage is sufficient to enable air to enter the container in response to a liquid exiting the container through the pour spout.

Example 15 is a pour spout as in any of Examples 11-14, wherein the collar is attached to the external side of the first sidewall at a distal end of the first sidewall, and wherein the distal end of the first sidewall is located nearest to the distal portion of the pour spout.

Example 16 is a pour spout as in any of Examples 11-15, wherein the proximal portion further comprises: a first circumferential sealing ring attached to the first sidewall at a proximal end of the first sidewall; and a conduit attached to the first circumferential sealing ring.

Example 17 is a pour spout as in any of Examples 11-16, wherein the conduit comprises a hollow cylindrical geometry defining a conduit internal cavity; wherein the conduit internal cavity is in fluid communication with the first internal cavity; and wherein liquid disposed within the container enters the pour spout through the conduit internal cavity.

Example 18 is a pour spout as in any of Examples 11-17, wherein the second sidewall comprises a plurality of bends, and wherein the plurality of bends determine a cross-sectional geometry of the terminal opening.

Example 19 is a pour spout as in any of Examples 11-18, wherein the second sidewall comprises four bends such that the terminal opening comprises a quadrilateral cross-sectional geometry.

Example 20 is a pour spout as in any of Examples 11-19, wherein the second sidewall comprises three bends such that the terminal opening comprises a triangular cross-sectional geometry.

Example 21 is a pour spout as in any of Examples 11-20, wherein the second sidewall comprises two bends such that the terminal opening comprises a two-sided cross-sectional geometry.

Example 22 is a pour spout as in any of Examples 11-21, wherein the proximal portion further comprises a plurality of circumferential sealing rings attached to the external side of the first sidewall; and wherein a length of at least two of the plurality of circumferential sealing rings is different.

Example 23 is a pour spout as in any of Examples 11-22, wherein the first sidewall comprises a cylindrical geometry or a tapered cylindrical geometry such that the first internal cavity comprises a cylindrical cavity or a tapered cylindrical cavity.

Example 24 is a pour spout as in any of Examples 11-23, wherein the second sidewall comprises a cylindrical geometry or a tapered cylindrical geometry such that the second internal cavity comprises a cylindrical cavity or a tapered cylindrical cavity.

Example 25 is a pour spout as in any of Examples 11-24, wherein the first sidewall comprises a cylindrical geometry such that the first internal cavity comprises a cylindrical cavity; and wherein the second sidewall comprises a tapered cylindrical geometry such that the second internal cavity comprises a tapered cylindrical cavity.

Example 26 is a pour spout as in any of Examples 11-25, further comprising an internal seal, wherein the internal seal prevents a fluid from exiting the pour spout through the terminal opening.

Example 27 is a pour spout as in any of Examples 11-26, wherein the internal seal is attached to an internal side of the second sidewall such that the internal seal is located within the second internal cavity.

Example 28 is a pour spout as in any of Examples 11-27, wherein the internal seal is attached to an internal side of the first sidewall such that the internal seal is located within the first internal cavity.

Example 29 is a pour spout as in any of Examples 11-28, wherein the internal seal comprises a break point such that the internal seal opens in response to applying the pressure to the second sidewall, and wherein opening the internal seal enables the fluid to exit the pour spout through the terminal opening.

Example 30 is a pour spout as in any of Examples 11-29, wherein all components of the pour spout are constructed of a compliant material.

The foregoing description has been presented for the purposes of illustration and description. It is not intended to be exhaustive or to limit the disclosure to the precise form disclosed. Many modifications and variations are possible in light of the above teaching. Further, it should be noted that any or all the aforementioned alternate implementations may be used in any combination desired to form additional hybrid implementations of the disclosure.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

In the foregoing Detailed Description, various features of the disclosure are grouped together in a single implementation for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed implementation. Thus, the following claims are hereby incorporated into this Detailed Description by this reference, with each claim standing on its own as a separate implementation of the disclosure.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

Reference throughout this specification to "an example" means that a particular feature, structure, or characteristic described in connection with the example is included in at least one embodiment of the present disclosure. Thus, appearances of the phrase "in an example" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present disclosure may be referred to herein along with alternatives for the various components thereof. It is understood that such embodiments, examples, and alternatives are not to be construed as de facto equivalents of one another but are to be considered as separate and autonomous representations of the present disclosure.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered illustrative and not restrictive.

Those having skill in the art will appreciate that many changes may be made to the details of the above-described embodiments without departing from the underlying principles of the disclosure. The scope of the present disclosure should, therefore, be determined only by the following claims.

What is claimed is:

1. A pour spout comprising:

a proximal portion configured to be inserted into an opening of a container, wherein the proximal portion comprises:

a first sidewall defining a first internal cavity; and a collar attached to an external side of the first sidewall; and a distal portion configured to extend outside the container when the proximal portion is inserted into the opening of the container, wherein the distal portion comprises:

a second sidewall defining a second internal cavity; and a terminal opening located at a distal end of the second sidewall;

wherein the second sidewall comprises a bend; and wherein at least a portion of the second sidewall collapses along the bend to reduce a size of the terminal opening in response to applying a pressure to the second sidewall.

2. The pour spout of claim 1, wherein the collar forms a liquid-tight seal against the opening of the container when the proximal portion is inserted into the opening of the container.

3. The pour spout of claim 2, wherein a portion of the collar detaches from the opening of the container in response to applying the pressure to the second sidewall.

4. The pour spout of claim 2, wherein a portion of the collar detaches from the opening of the container in response to applying the pressure to the second sidewall to generate an airflow passage in between the container and the proximal portion; and wherein the airflow passage is sufficient to enable air to enter the container in response to a liquid exiting the container through the pour spout.

5. The pour spout of claim 1, wherein the collar is attached to the external side of the first sidewall at a distal end of the first sidewall, and wherein the distal end of the first sidewall is located nearest to the distal portion of the pour spout.

6. The pour spout of claim 5, wherein the proximal portion further comprises:

a first circumferential sealing ring attached to the first sidewall at a proximal end of the first sidewall; and a conduit attached to the first circumferential sealing ring.

7. The pour spout of claim 6, wherein the conduit comprises a hollow cylindrical geometry defining a conduit internal cavity;

wherein the conduit internal cavity is in fluid communication with the first internal cavity; and wherein liquid disposed within the container enters the pour spout through the conduit internal cavity.

8. The pour spout of claim 1, wherein the second sidewall comprises a plurality of bends, and wherein the plurality of bends determine a cross-sectional geometry of the terminal opening.

9. The pour spout of claim 1, wherein the second sidewall comprises four bends such that the terminal opening comprises a quadrilateral cross-sectional geometry.

10. The pour spout of claim 1, wherein the second sidewall comprises three bends such that the terminal opening comprises a triangular cross-sectional geometry.

11. The pour spout of claim 1, wherein the second sidewall comprises two bends such that the terminal opening comprises a two-sided cross-sectional geometry.

12. The pour spout of claim 1, wherein the proximal portion further comprises a plurality of circumferential sealing rings attached to the external side of the first sidewall; and wherein a length of at least two of the plurality of circumferential sealing rings is different.

13. The pour spout of claim 1, wherein the first sidewall comprises a cylindrical geometry or a tapered cylindrical geometry such that the first internal cavity comprises a cylindrical cavity or a tapered cylindrical cavity.

14. The pour spout of claim 1, wherein the second sidewall comprises a cylindrical geometry or a tapered cylindrical geometry such that the second internal cavity comprises a cylindrical cavity or a tapered cylindrical cavity.

15. The pour spout of claim 1, wherein the first sidewall comprises a cylindrical geometry such that the first internal cavity comprises a cylindrical cavity; and wherein the second sidewall comprises a tapered cylindrical geometry such that the second internal cavity comprises a tapered cylindrical cavity.

16. The pour spout of claim 1, further comprising an internal seal, wherein the internal seal prevents a fluid from exiting the pour spout through the terminal opening.

17. The pour spout of claim 16, wherein the internal seal is attached to an internal side of the second sidewall such that the internal seal is located within the second internal cavity.

18. The pour spout of claim 16, wherein the internal seal is attached to an internal side of the first sidewall such that the internal seal is located within the first internal cavity.

19. The pour spout of claim 16, wherein the internal seal comprises a break point such that the internal seal opens in response to applying the pressure to the second sidewall, and wherein opening the internal seal enables the fluid to exit the pour spout through the terminal opening.

20. The pour spout of claim 1, wherein all components of the pour spout are constructed of a compliant material.

* * * * *